US007305931B1

(12) United States Patent
Benson et al.

(10) Patent No.: US 7,305,931 B1
(45) Date of Patent: Dec. 11, 2007

(54) RIGID CHAMBERED BOAT HULL WITH INFLATABLE PERIMETER

(76) Inventors: Rick Benson, 803 Harris Ave., Suite 9, Bellingham, WA (US) 98225; William Hickok, 803 Harris Ave., Suite 9, Bellingham, WA (US) 98225; Larry Wieber, 803 Harris Ave., Suite 9, Bellingham, WA (US) 98225; Vincent McLeod, 803 Harris Ave., Suite 9, Bellingham, WA (US) 98225

( * ) Notice: Subject to any disclaimer, the term of this patent is extended or adjusted under 35 U.S.C. 154(b) by 0 days.

(21) Appl. No.: 11/149,619

(22) Filed: Jun. 10, 2005

Related U.S. Application Data

(60) Provisional application No. 60/579,050, filed on Jun. 10, 2004.

(51) Int. Cl.
*B63B 7/06* (2006.01)

(52) U.S. Cl. ..... 114/345

(58) Field of Classification Search ..... 114/345
See application file for complete search history.

(56) References Cited

U.S. PATENT DOCUMENTS 4,545,319 A 10/1985 Ferronniere et al.
4,817,555 A 4/1989 Meinen
4,928,619 A 5/1990 Cochran
4,976,213 A 12/1990 Smith
5,033,401 A 7/1991 Bartlett
5,184,564 A 2/1993 Robbins et al.
5,228,407 A * 7/1993 Cummer et al. ..... 114/345
5,540,177 A * 7/1996 Masters ..... 114/361
5,584,260 A * 12/1996 Hemphill ..... 114/345
5,819,682 A 10/1998 Pestel
6,105,532 A 8/2000 Eilert
6,223,677 B1 5/2001 Hall et al.
6,484,656 B2 11/2002 Mears
6,508,193 B2 1/2003 DeQuatrebarbes

* cited by examiner

*Primary Examiner*—Sherman Basinger
(74) *Attorney, Agent, or Firm*—Michael F. Hughes; Hughes Law Firm, PLLC

(57) ABSTRACT

A boat hull having sealed rigid chambers and a perimeter inflatable portion positioned and attached laterally outward thereof. The perimeter inflatable portions provide redundant buoyancy and allow loads acting upon the hull to be shifted laterally without compromising stability of the boat.

19 Claims, 4 Drawing Sheets

RIGID CHAMBERED BOAT HULL WITH INFLATABLE PERIMETER

RELATED APPLICATIONS

This application claims priority benefit of U.S. Ser. No. 60/579,050, filed Jun. 10, 2004.

BACKGROUND OF THE INVENTION

Rigid hull inflatable boats are well known in prior art and have been used as transportation on the water whereby the inflatable members provide a buoyant force to keep the boat floating on water.

Chambered hull boats have been disclosed in the prior art and one such boat owned by Aluminum Chambered Boats, LLC of this application is U.S. Pat. No. 6,520,107 which disclose a multiple chambered boat where the chambers are positioned on the lateral end forward portions of the hull.

By way of background, stability tests are required for certain applications Coast Guard approval, and particularly for a commercial passenger service. Such stability tests position the maximum number of people the boat can hold is placed on one lateral side portion of the boat. With a normal type of boat, this will tip or seriously compromise the balance of the buyoancing forces adapted to handle the load.

It should be further noted that many military and law enforcement boats engage in a "fendering" operation with when these boats are approaching vessels at high speeds and do not allow for a great deal of time to de-accelerate the boat. The fendering maneuver is particularly useful in high-speed pursuit where the boat with the perimeter inflatable collar must engage a boat at sea, presumably under high speeds, de-accelerating such that the perimeter buoyant portion further allows for a certain amount of de-acceleration upon impact to prevent or mitigate damage to either vessel.

Many inflatable chambers as disclosed in the prior art comprise either rigid chambers or inflatable chambers in a mutually exclusive fashion. In such references such as U.S. Pat. No. 5,184,564, there is disclosed a perimeter buoyant member for a personal watercraft such as a jet ski. However, in a multi-passenger boat (where passengers can substantially reposition themselves about the craft), the center of gravity of the entire boat and load substantially shifts from the center longitudinal axis of the boat. This shifting of the center of gravity must be countered with a buoyant lifting force.

Further, in certain situations, it is very desirable to store the boat in a compact region such as in the central storage area of a C-130 aircraft. In such a situation, it is very desirable to store a deployable boat where the boat requires a minimum volume. However, in certain situations it is desirable to immediately deploy the boat without the need to invest time for preparing it in any manner. Therefore, providing a boat that has the buoyant properties with rigid buoyant chambers that independently provides a vertical floating buoyant force from the inflatable perimeter members provides a more robust safe design. By deflating the perimeter inflatable members, the net width and overall volume of the boat is reduced and yet by providing the redundant rigid sealed chambers, the boat is seaworthy in this state.

SUMMARY OF THE DISCLOSURE

Described below is a multi-passenger boat comprising a rigid boat hull that has a center reference longitudinal axis with a forward region, a rearward region as well as port and starboard lateral regions. The boat hull further comprising a perimeter region where the perimeter region has a plurality of sealed rigid chambers separated by baffles where an outer concave surface is positioned laterally outward from the plurality of sealed non flexible chambers.

A perimeter inflatable member is provided that has an interior surface adapted to approximately conform to the outer concave surface. the perimeter inflatable member or the plurality of sealed rigid chambers independently provide a sufficient amount of buoyant force to maintain the rigid boat hull afloat. The perimeter inflatable member is adapted to be deflated to reduce the overall lateral width of the multi-passenger boat and the multi-passenger boat is adapted to be deployed and float when the perimeter inflatable member is deflated.

The inflatable flexible members further provide a lower surface adapted to provide additional support for the boat hull about the longitudinal axis whereby the maximum required load of the multi-passenger boat hull can be positioned at a medial lateral portion thereof and maintain stability about the longitudinal axis

DETAILED DESCRIPTION OF THE PREFERRED EMBODIMENTS

Figure 1:
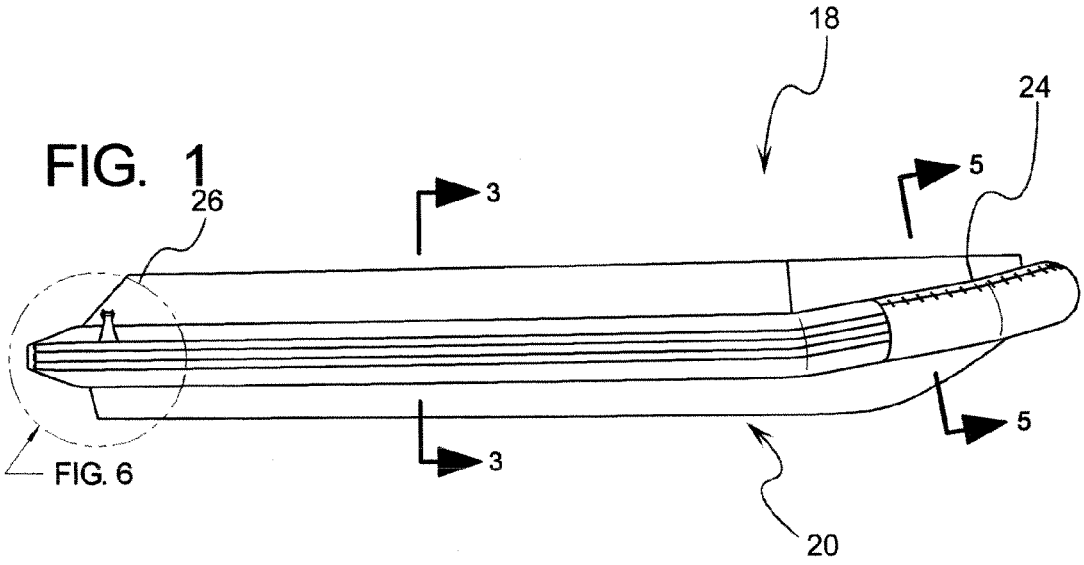
FIG. 1 is a side view of the chambered boat hull.
Figure 2:
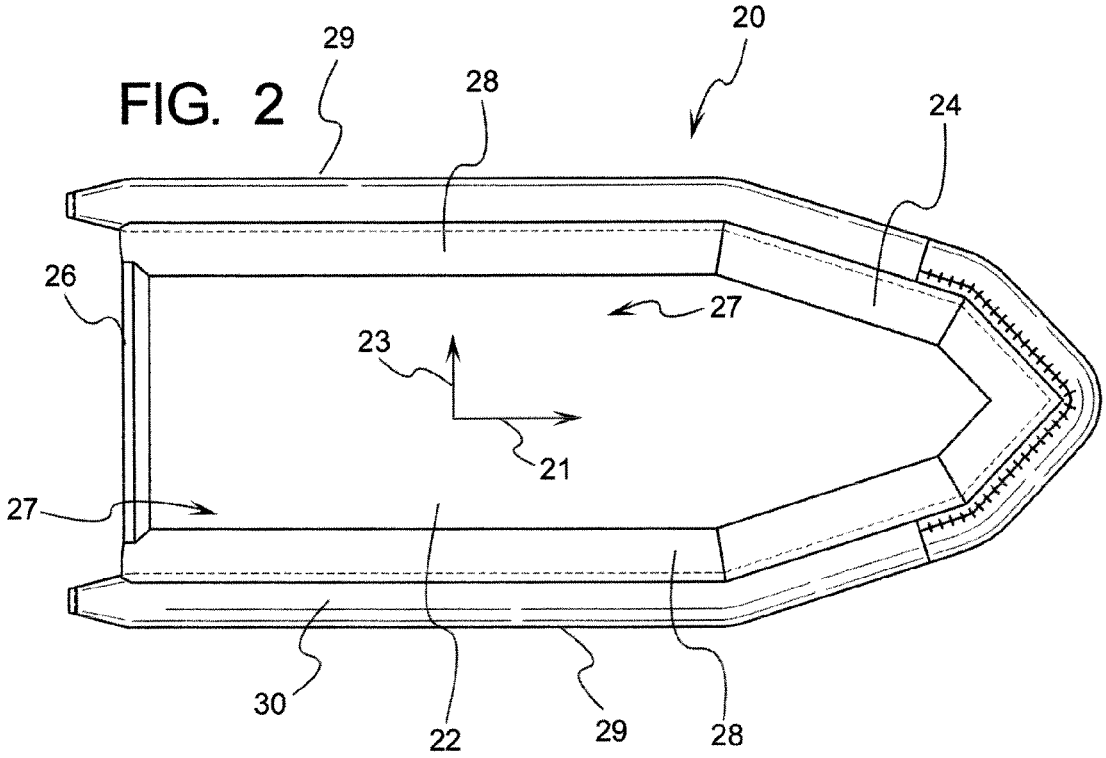
FIG. 2 is a top view of the chambered boat hull where a medial lateral portion is shown.

As shown in FIG. 1 there is shown a multi-passenger boat 18 having a chambered boat hull 20 which in one form comprises a plurality of inner chambers positioned around the perimeter hull portion 28 as shown in FIG. 2. In general, the boat hull comprises a central region 22, a bow 24, a stern 26, the aforementioned perimeter hull portion 28 and an inflatable perimeter 30.

The chambered boat hull 20 has a central longitudinal axis 21 that generally runs from the bow 24 to the stern 26 (see FIG. 2). For reference purposes the chambered boat hull 20 further has a lateral axis 23 and a vertical axis orthogonal to the longitudinal and lateral axis 21 and 23 respectively.

In one form, the chambered hull is substantially manufactured pursuant to the description of U.S. Pat. No. 6,520,107 which is herein incorporated by reference.

Figure 3:
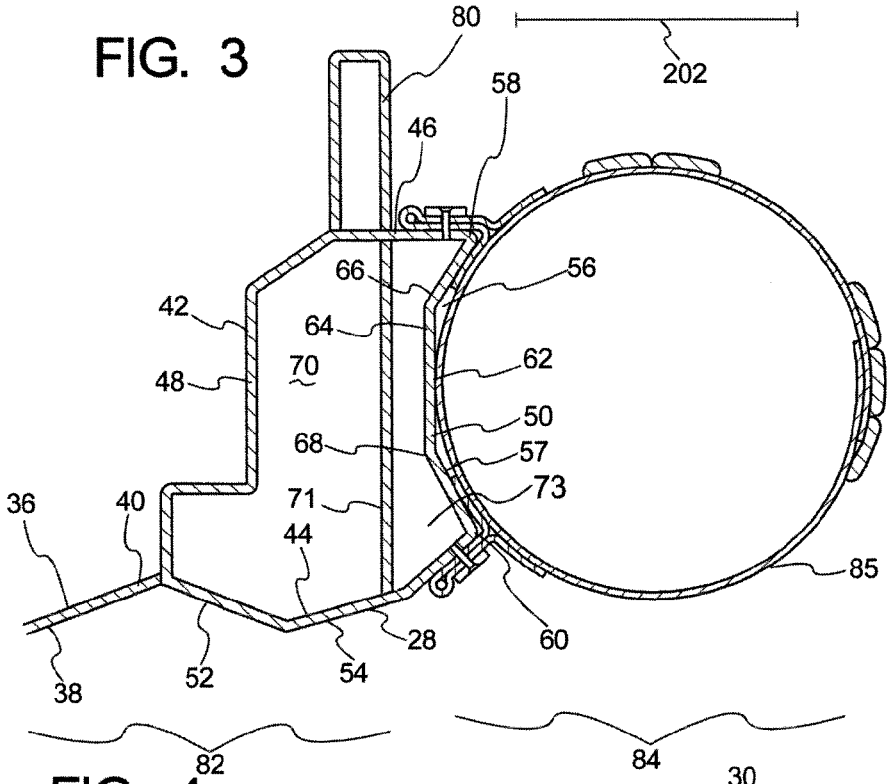
FIG. 3 is a longitudinal cross sectional view taken at line 3-3 of FIG. 1.

As shown in FIG. 3, the central region 22 comprises a lower wall 36 having a lower surface 38. The lower surface 38 is adapted to engage the body of water which the chambered boat hull 20 rides upon. The lower wall 36 has a lateral portion 40 that is fixedly connected to the perimeter hull portion 28. In one form, the perimeter hull portion 28 is comprised of a multi-creased perimeter wall section 42 as shown in FIG. 3. The multi-creased perimeter wall section has a lower portion 44, and upper portion 46, a laterally inward portion 48 and laterally outward portion 50.

The lower portion 44 of the multi-creased perimeter wall section 42 has a first surface 52 and a laterally outward surface 54. The first surface 52 is adapted to engage water traveling up the lower surface 38 when the boat hull 20 is planing along a body of water. The laterally outward portion 50 has a lateral indent region 56 where the upper lateral corner 58 and the lower lateral corner 60 extend laterally outward a greater degree than the laterally central region 62 as shown in FIG. 3. One form, the lateral indent region 56 is comprised of a multi-creased wall section 64 which comprises an upper crease 66 and a lower crease 68. It should be noted that the outer concave surfaces positioned laterally outward from the sealed non flexible chambers need not be around the entire perimeter but a preferred form a substantial portion thereof. The various wall portions of the multi-creased perimeter wall section 42 define a rigid chamber 70.

As shown in FIG. 3, the outer chamber wall 71 is adapted to define the rigid chamber 70. Positioned laterally outward thereof is a secondary chamber 73 where the fasteners 114 and 134 are adapted to extend into this region in a fastening system as described below. It should be noted that the outer chamber wall 71 can be positioned in a variety of orientations, and in one form, the material to define the lateral end region 56 is welded to the outer surface of the outer chamber wall 71.

Figure 4:
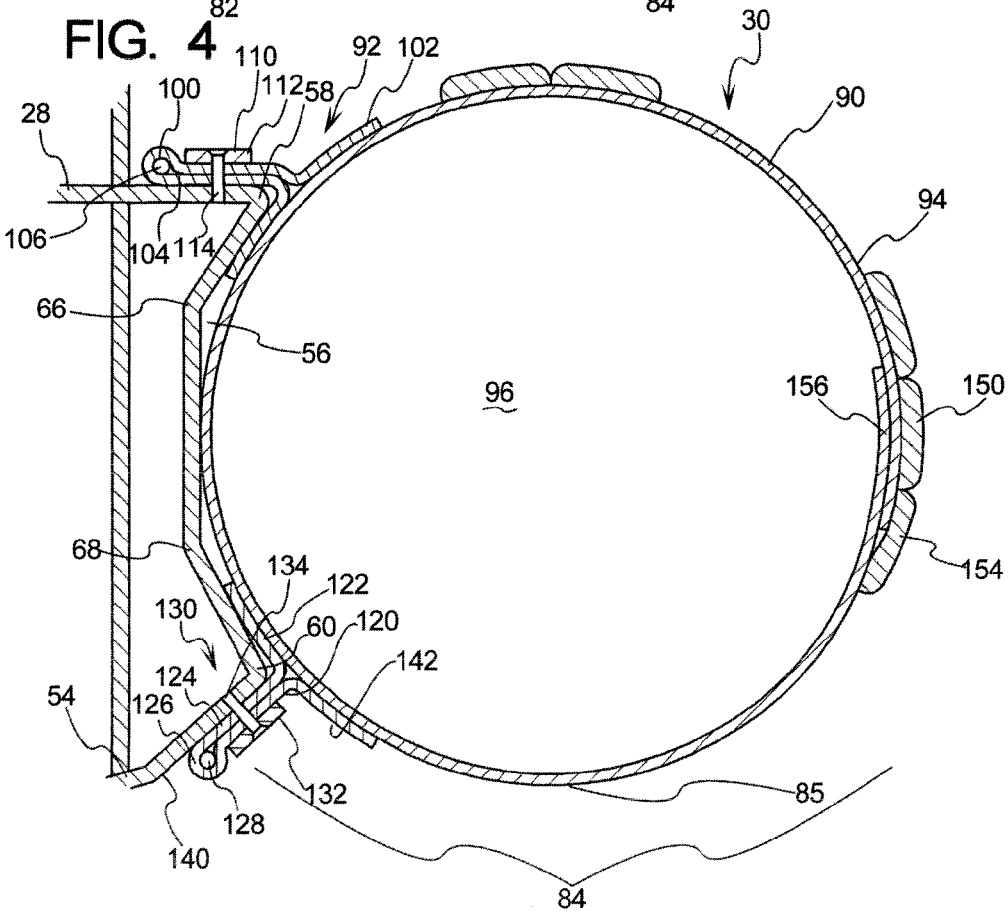
FIG. 4 is a cross sectional view of the inflatable perimeter region.

A perimeter vertically extending member 80 is attached to the upper portion 46 of the multi-creased perimeter wall section 42 as shown in FIG. 3. In general, the lower wall 36, the multi-creased perimeter wall section 42 as well as the vertically extending member 80 which is rigidly attached thereto comprise a laterally rigid portion 82 of the chambered boat hull 20. The inflatable lateral portion of the boat hull 20 is indicated by the general section 84 in FIG. 3. As shown in FIG. 4, positioned in the inflatable lateral portion 84 is the inflatable perimeter 30. The inflatable perimeter 30 comprises an inflatable membrane 90 having an attachment region 92 and a laterally outward region 94. In general, the inflatable membrane 90 is comprised of a flexible type material that is relatively wear resistant and adapted to hold air or other gas therein the inflatable chamber region 96.

The attachment region 92 in one form comprises an upper attachment member 100 which has a base region 102 that is attached to the inflatable member 90. The base region 102 can be attached to the inflatable member 90 by way of an adhesion, stitching or other suitable method of attachment that are known in the art. The upper attachment member 100 has an extension 104 which in one form produces a loop with rod like material 106 longitudinally extending therearound the perimeter region of the chambered boat hull 20. A fastening system 110 which comprises the longitudinally extending member 112 and a plurality of connectors 114 which in a preferred form are pop rivet type fasteners or the material indicated at 46 is tapped to receive a threaded fastener where the head region of the fastener is recessed in a frustoconical cavity of the longitudinally extending member 112. It should be noted that the terms longitudinally extending are referred to in majority of the portions of the described regions relating to the inflatable perimeter 30. However, as shown in FIG. 2, at portions near the bow 24, the regions converge inwardly and only partially run longitudinally but still is designed to run longitudinally. A medial lateral portion is shown at 27 at approximately the location indicated at 27 which is an area between the far lateral portions 29 and the center axis 21 of the multi-passenger boat 18. As discussed further below, the hull 20 is adapted to handle shifting of the center of gravity in situations where say all of the passengers go to one side of the boat for rescue operations or other reasons such as merely site seeing where an attraction is at one lateral side of the boat 18.

Now referring to the lower part in FIG. 4, the lower attachment member 120 is similar to the upper attachment member where similar portions are attributed similar names and as such the description of the upper attachment member is relevant and provides the basis of description for the lower attachment member 120. However, the general portions of the lower attachment member are now described where the base region 122 is fixedly attached to the inflatable member 90 by any suitable means. The extension 124 is adapted to have a lip region 126 which in one form is created by the rod 128 whereby the fastening system 130 comprises the longitudinally extending lower member 132 where a plurality of fasteners 134, similar to that has fasteners 114, restrict the distance between the longitudinally extending lower member 132 and the laterally outward surface 54 whereby the lip 126 cannot pass therethrough. Of course this is a similar fastening system as the upper fastening system 110.

Figure 5:
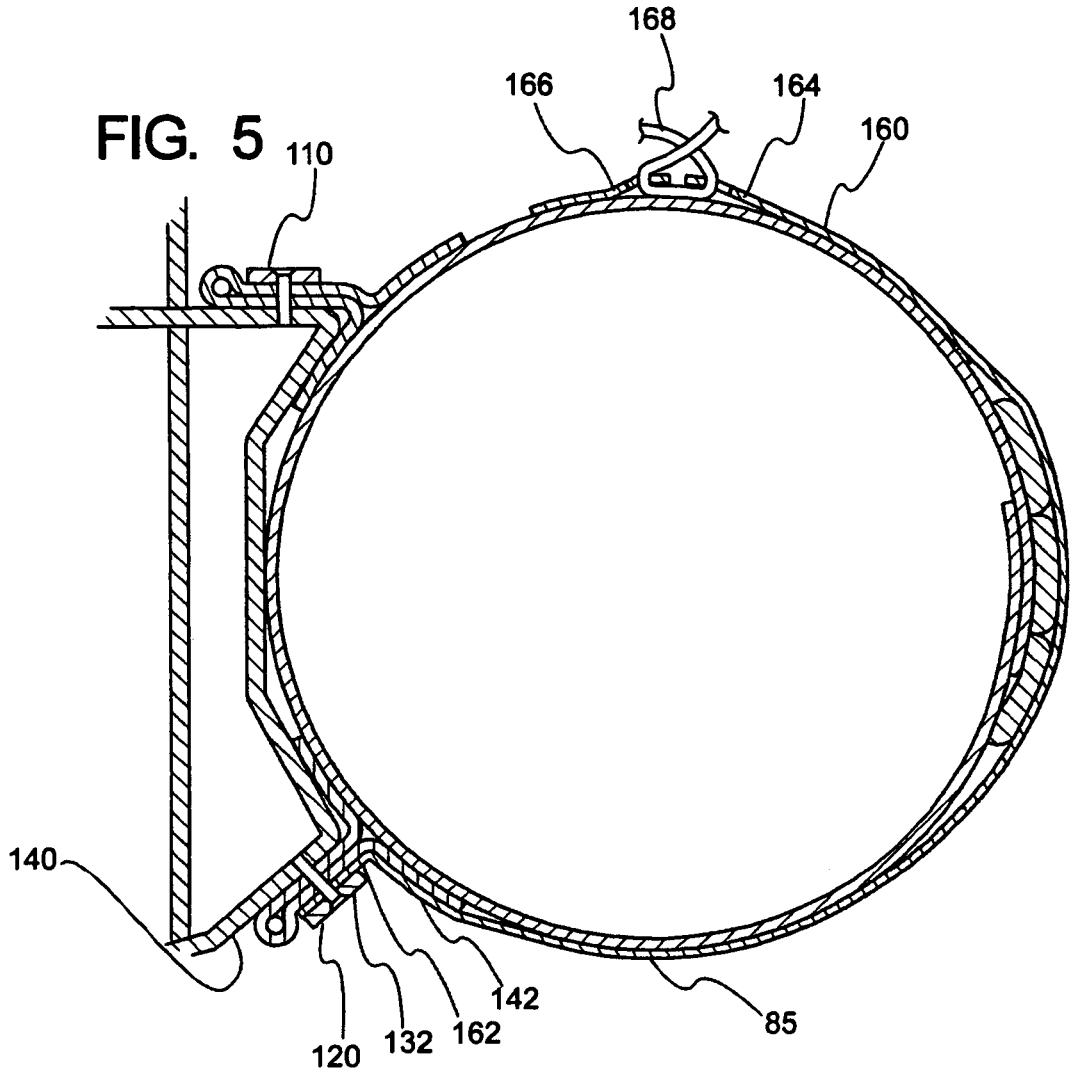
FIG. 5 is a cross sectional view at line 5-5 of FIG. 1 of the bow region of the inflatable perimeter showing the bra attached thereto.

As shown in FIG. 4, the lateral indent region 56 defining an outer concave surface 57 of the perimeter hull portion 28 is adapted to receive the conical inflated cross-sectional outer surface of the inflatable member 90. Therefore, the lateral indent region 56 is well suited to rigidly support the inflatable perimeter 30. The inflatable perimeter 30 in general further comprises a lateral upward region 140 and a lateral downward region 142 as shown in FIG. 5 where each of these regions have corresponding outer surface is that are adapted to engage the surface of the body of water in which the chambered boat hull 20 rides upon. It has been found that the outer surface of the lateral downward region 142 provides additional stability and support characteristics to smooth the ride in high speeds. It should further be noted that as shown in FIG. 3, the rigid chamber 70 provides enough buoyant lift whereby the chambered boat hull can remain afloat when the inflatable chamber region is not inflated. This is advantageous where it is desired to deploy the chambered boat hull 20 from a stored location such as a C-130 aircraft. When the chambered boat hull is transported in a confined space, it is desirable to reduce the overall size of the chambered boat hull 20. Of course, the chambered boat hull 20 may have additional elements attached to it such as a center module, collapsible roof assembly, some form of motor and prop system, etc. It has been found that the chambered boat hull 20 comprising a rigid chamber 70 made from a material such as aluminum and an inflatable chamber region 96 cooperate to provide an extremely smooth boat that is particularly well adapted to corner and remain afloat in extreme conditions. Further, the chambered boat hull 20 is extremely safe whereby the redundant chambers provide a great deal of buoyant force to keep the boat afloat in the event the chambered boat hull 20 is damaged by external impacts from rocks and the like or "tore up" by small arm fire or other projectiles.

The inflatable member 90 further comprises an impact region 150 that is positioned in the laterally outward region 94 whereby the impact region 150 has impact resilient material 154 attached to the laterally outward region 94. In one form, the fold over seal 156 is contained behind this impact resilient material 154 for protection purposes. The impact region 150 is particularly advantageous for low-speed and high-speed collisions of the chambered boat hull 20 against other objects on the water line in the body of water. For example, when the chambered boat hull 20 is pulling up adjacent to a ship at a relatively high speed, the impact region 150 is well suited for allowing a lower deceleration impact than a rigid hull. The nature of the inflatable member 90 is such that the cross sectional circular shape is adapted to transform to an oval like shape temporarily when an impact occurs whereby the lateral displacement of the chambered boat hull 20 takes place over a longer period of time reducing the felt impact. Further, the impact region 50 allows for a quieter impact in the event of a high-speed operation where operators contained on the chambered boat hull 20 are commandeering a dock or another vessel and desire to have a fast but quiet engagement. Further, in the event of defending a larger ship, having an impact region is advantageous where the chambered boat hull 20 is functioning as a patrol unit and deterring small vessels from a larger ship to prevent a catastrophe such as the USS Cole incident. It should be noted that in operation, in some forms, the inflatable perimeter member 30 is completely out of the water, not providing any buoyant lift particularly when the boat is planing. However, the lower surface 85 of the buoyant member 30 is in a proper position to engage the upper surface of the water to provide stability and support during say a high wave, cornering or a shifting of the center of gravity towards one lateral portion of the boat. It should be noted that the outer concave surfaces positioned laterally outward from the sealed non flexible chambers need not be around the entire perimeter but a preferred form a substantial portion thereof.

Figure 6:
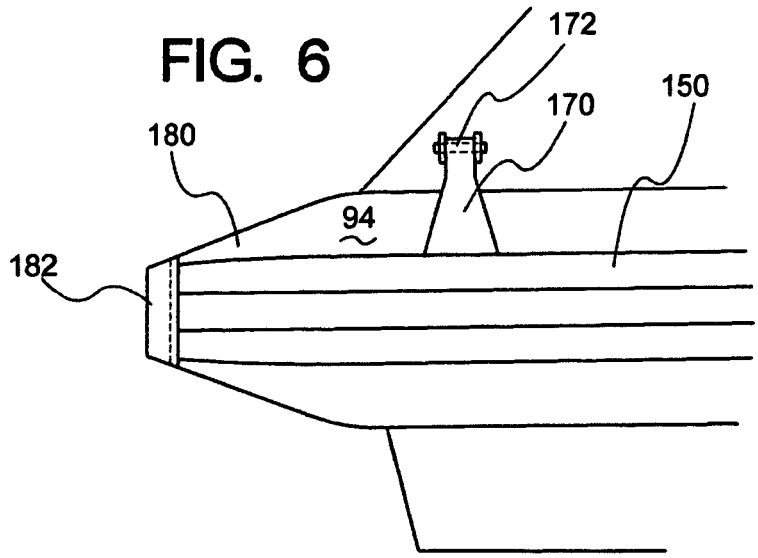
FIG. 6 is a side view of the rear portion of the chambered boat hull.

FIG. 5 shows a cross sectional view of the forward portion of the inflatable perimeter 30 where a protective bra 160 is provided. The bra has a lower region 162 which in one form is adapted to be fastened and interposed between the laterally outward surface 54 and the longitudinally extending lower member 132. The protective bra 160 further comprises an upper lateral end 164 that is adapted to be fastened to a portion 166 with a rope or twine 168. The protective bra 160 can be made of Kevlar or other wear resistant material. The bra is particularly conducive for protecting the front portion of the boat in the event of a front impact upon another vessel. Further, the bra is particularly advantageous in the event that a continuous wear is occurring upon the boat. For example in the event of a change in tide or a series of waves where the boat is docked to a non-floating dock and the boat oscillates in a manner to rub against the stationary abrasive dock material, the bra is adapted to have better wear characteristics and prevent damage to the underlying material. As shown in FIG. 6, laterally extending flexible members 170 can be provided that are attached to the laterally outward region 94 at one end portion and the other end portion is rigidly attached to the rigid portion of the hull at connection point 172. The inflatable perimeter 30 further has a rearward extension 180 having a rubber bumper plate 182 that is well suited for wear and impact. It should be noted that the inflatable perimeter region is positioned laterally adjacent to the concave portion whereby fendering is feasible and reduces the amount of stress exerted upon the fastening portions f fastening the inflatable perimeter region to the rigid hull portion. In other words, by having the location of the fastening portions and upper and lower locations (as opposed to just a lower or upper portion), the inflatable perimeter has direct compressive contact with the concave portion in not producing a moment about either the upper or lower fastening regions.

Figure 7:
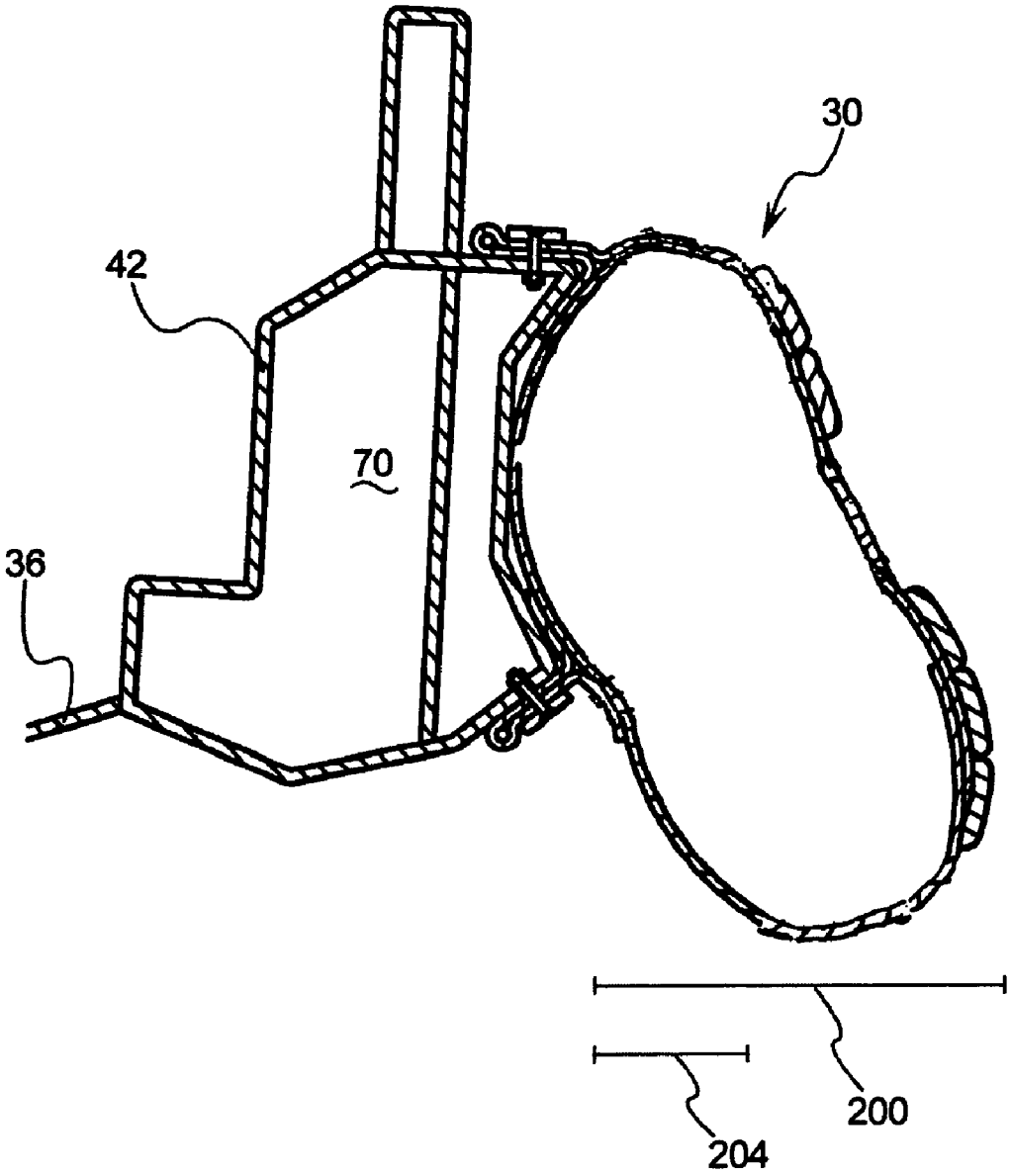
FIG. 7 shows the inflatable perimeter in a partially deflated state narrowing the lateral overall width of the chambered boat hull.

FIG. 7 shows the inflatable perimeter 30 in a deflated state whereby the lateral width of the chambered boat hull 20 is substantially reduced in a deflated state. It is advantageous to have a chambered boat hull that can be deployed in such a deflated state and still be functional and have a sufficient amount of buoyant lift so the chambered boat hull 20 can remain afloat. As illustrated in FIG. 7, the inflatable perimeter 30 is substantially deflated and as can be seen in this figure, the lateral width 200 is narrower than the width 202 as shown in FIG. 3. Of course being in a deflated state, the width of the total lateral distance from the rigid portion of the chambered hull could compress to a distance as shown in 204 of FIG. 7. Therefore, it can be appreciated that numerous boats can occupy a smaller footprint area within a tight confinement when the inflatable perimeter 30 is deflated. The width of the inflatable perimeter 30 can be narrowed as much as 50% and in a more preferred form over 60% up to 80% of the inflated width.

Of course various modifications and alternative forms of the a chambered boat hull can be employed where specific embodiments thereof have been shown by way of example in the drawings and described above in detail. It should be understood, however, that such an enabling description is not intended to limit the invention to the particular form disclosed, but rather, on the contrary the intention of such disclosure and claims set forth below is to cover all modifications, equivalence and alternatives falling within the spirit and scope of the claims.

We claim:

1. A multi-passenger boat comprising a rigid boat hull having a center longitudinal axis with a forward region, a rearward region and port and starboard lateral regions, the boat hull further comprising a perimeter region where the perimeter region has a plurality of sealed rigid chambers separated by baffles where an outer concave surface is positioned laterally outward from the plurality of sealed rigid chambers; a perimeter inflatable member having an interior surface adapted to approximately conform to the outer concave surface, where the perimeter inflatable member or the plurality of sealed non-flexible chambers independently provide a sufficient amount of buoyant force to maintain the rigid boat hull afloat and the perimeter inflatable member is adapted to be deflated to reduce the overall lateral width of the multi-passenger boat and the multi-passenger boat is adapted to be deployed and float when the perimeter inflatable member is deflated whereby the perimeter inflatable member reduces in size in the lateral direction greater than 50% when deflated compared to the fully inflated state and a protective bra having an impact region comprised of impact resilient material is positioned in a forward region of the perimeter inflatable member where a fold over seal comprises a portion of the impact region.

2. The multi-passenger boat as recited in claim 1 whereby the perimeter inflatable member is comprised of a plurality of independent inflatable chambers.

3. The multi-passenger boat as recited in claim 2 whereby the perimeter inflatable member provides an additional vertical buoyant force when a net center of gravity of the multi-passenger boat is positioned away from the center longitudinal axis.

4. The multi-passenger boat as recited in claim 1 whereby the perimeter inflatable member provides an additional vertical buoyant force when a net center of gravity of the multi-passenger boat is positioned away from the center longitudinal axis.

5. A multi-passenger boat hull having a longitudinal axis and comprising a rigid portion and a flexible portion, the rigid portion of the boat hull comprises a central rigid portion having lateral portions where rigid chambers are defined in the lateral portions, a concave surface is defined on a laterally outward region of the rigid chambers and the flexible portion is attached thereto and comprises a plurality of inflatable flexible members that are of sufficient volume to provide a buoyant lift to independently float the boat hull of the rigid chambers whereby the plurality of inflatable flexible members reduce in size in the lateral direction greater than 50% when deflated compared to the fully inflated state, whereas the inflatable flexible members provide a lower surface adapted to provide additional support for the boat hull about the longitudinal axis whereby the maximum required load of the multi-passenger boat hull can be positioned at a medial lateral portion thereof and maintain stability about the longitudinal axis whereby a protective bra having an impact region comprised of impact resilient material is positioned in a forward region of the perimeter inflatable member where a fold over seal comprises a portion of the impact region.

6. The multi-passenger boat as recited in claim 5 where the protective bra is made from bullet resistant material.

7. The multi-passenger boat as recited in claim 5 whereby the lower surface of a substantial portion of the inflatable flexible members are positioned in a manner to not engage a surface of water thereunder when the multi-passenger hull is planing.

8. The multi-passenger boat as recited in claim 7 where the lower surface of a substantial portion of the inflatable flexible members are adapted to engage the surface of the water when the multi-passenger boat is turning.

9. The multi-passenger boat hull as recited in claim 5 where laterally extending flexible members are attached to a lateral outward region of the plurality of inflatable flexible members at one end portion and another end portion is rigidly attached to the rigid portion.

10. The multi-passenger boat hull as recited in claim 9 where an impact resistant material is positioned in a laterally outward region of the plurality of inflatable flexible members.

11. The multi-passenger boat hull as recited in claim 9 where the central rigid portion is comprised of aluminum.

12. The multi-passenger boat hull as recited in claim 5 where the impact resistant material is positioned in a laterally outward region of the plurality of inflatable flexible members.

13. The multi-passenger boat as recited in claim 1 where the rigid chambers are comprised of aluminum.

14. The multi-passenger boat hull as recited in claim 5 where the central rigid portion is comprised of aluminum.

15. The multi-passenger boat as recited in claim 1 where the protective bra is comprised of Kevlar.

16. The multi-passenger boat hull as recited in claim 5 where the plurality of inflatable flexible members have a rearward extension having a rubber bumper plate attached to a rearward inflatable flexible member of the plurality of inflatable flexible members.

17. The multi-passenger boat as recited in claim 16 where the protective bra is comprised of Kevlar.

18. The multi-passenger boat hull as recited in claim 1 where the perimeter inflatable member comprises a rearward extension having a rubber bumper plate.

19. The multi-passenger boat as recited in claim 18 where the protective bra is comprised of Kevlar.

* * * * *